United States Patent [19]

Graeser, Jr. et al.

[11] 4,222,056

[45] Sep. 9, 1980

[54] SLOT ANTENNA LEAD CONNECTING APPARATUS

[75] Inventors: Joseph H. Graeser, Jr., Cortland; Richard A. Natoli, Girard; Robert J. Adkins, Warren, all of Ohio

[73] Assignee: General Motors Corporation, Detroit, Mich.

[21] Appl. No.: 49,105

[22] Filed: Jun. 18, 1979

[51] Int. Cl.[2] ..... H01Q 13/10

[52] U.S. Cl. ..... 343/767; 343/906; 174/75 C

[58] Field of Search ..... 343/711, 712, 713, 767, 343/769, 906; 174/75 C

[56] References Cited

U.S. PATENT DOCUMENTS

| | | | |
|---|---|---|---|
| 2,821,708 | 1/1958 | Blancher | 343/767 |
| 3,618,102 | 11/1971 | Dickason et al. | 343/906 |

*Primary Examiner*—Eli Lieberman

*Attorney, Agent, or Firm*—Robert M. Sigler

[57] ABSTRACT

Apparatus for connecting the female connector end of a coaxial antenna lead to the members of a slot antenna includes a first connecting member having a flat base connected to one antenna member with a pair of arms at the base end farthest from the slot adapted to engage the female end of the coaxial lead and connect the outer conductor to the one antenna member. A forked extension projects from the base end nearest the slot, and the base flares outwardly in width from the arms to the forked extension to dissipate the radial electromagnetic field of the coaxial lead so it does not interfere with the slot. A second conducting member includes a conductor adapted at one end to engage the inner conductor at the female connector end of the coaxial lead and at the other end to engage the other antenna member. An insulator engages the forked extension to interlock the first and second connecting members.

2 Claims, 2 Drawing Figures

SLOT ANTENNA LEAD CONNECTING APPARATUS

BACKGROUND OF THE INVENTION

This invention relates to apparatus for connecting an antenna lead to a slot antenna and more particularly to such apparatus for connecting the outer conductor of a coaxial antenna lead to one slot antenna member and the inner conductor of the coaxial antenna lead to the other slot antenna member.

Generally, in connecting of coaxial antenna lead to a slot antenna, it is convenient to connect the outer conductor of the coaxial lead to one of the slot antenna members and to continue the inner conductor across the slot for connection to the other slot antenna member. However, the electromagnetic field of a coaxial antenna lead is radial in direction between the inner and outer conductors; and, when the outer conductor is terminated before the slot, this field may tend to interfere with the electromagnetic field of the slot. Therefore it would be advantageous to provide apparatus for spreading and dissipating this electromagnetic field prior to the crossing of the slot by the inner conductor.

In addition, there is need for a simple, inexpensive apparatus for physically and electrically connecting the outer conductor of a coaxial antenna lead to one member of the slot antenna. It would be especially advantageous to provide such apparatus for making such a connection to the standard female connector end of such a coaxial cable, so that the end of such a coaxial cable need not be specially prepared for such connection.

SUMMARY OF THE INVENTION

It is therefore an object to provide apparatus for connecting the outer conductor of a coaxial antenna lead to one member of a slot antenna and the inner conductor to the other member in such a way that the radial electromagnetic field of the coaxial cable does not interfere with the electromagnetic field of the slot. It is a further object of this invention to provide such apparatus for the female connector end of a standard coaxial antenna lead cable so that the end of the cable need not be specially prepared for the connection.

These and other objects are realized in a first connecting member having a pair of arms adapted to engage the female end of the coaxial cable therebetween, at least one of said arms having an opening adapted to engage a radial projection of said female connector end. The first connecting member further comprises a flat base adapted for physical and electrical connection to one slot antenna member, the base flaring outwardly from a narrow width by said arms to a wider width closer to the slot for dissipation of the electromagnetic field of the coaxial cable.

The apparatus further comprises a second connecting member comprising a conducting lead having one end adapted for insertion in the female connector end of the coaxial cable and thereby for electrical connection with the inner coaxial conductor and the other end adapted for connection to the other antenna member across the slot. The second connecting member further comprises an insulating cover surrounding said lead and a further sealing cover surrounding said insulating cover. The first connecting member further comprises a forked extension extending generally perpendicularly up from the flat base at the wide end thereof and adapted to engage one end of the sealing member for retention of the second connecting member within the female connecting end of the coaxial cable.

Further details and advantages of this invention will be apparent from the accompanying drawings and following description of a preferred embodiment.

DESCRIPTION OF THE PREFERRED EMBODIMENT

Figure 1:
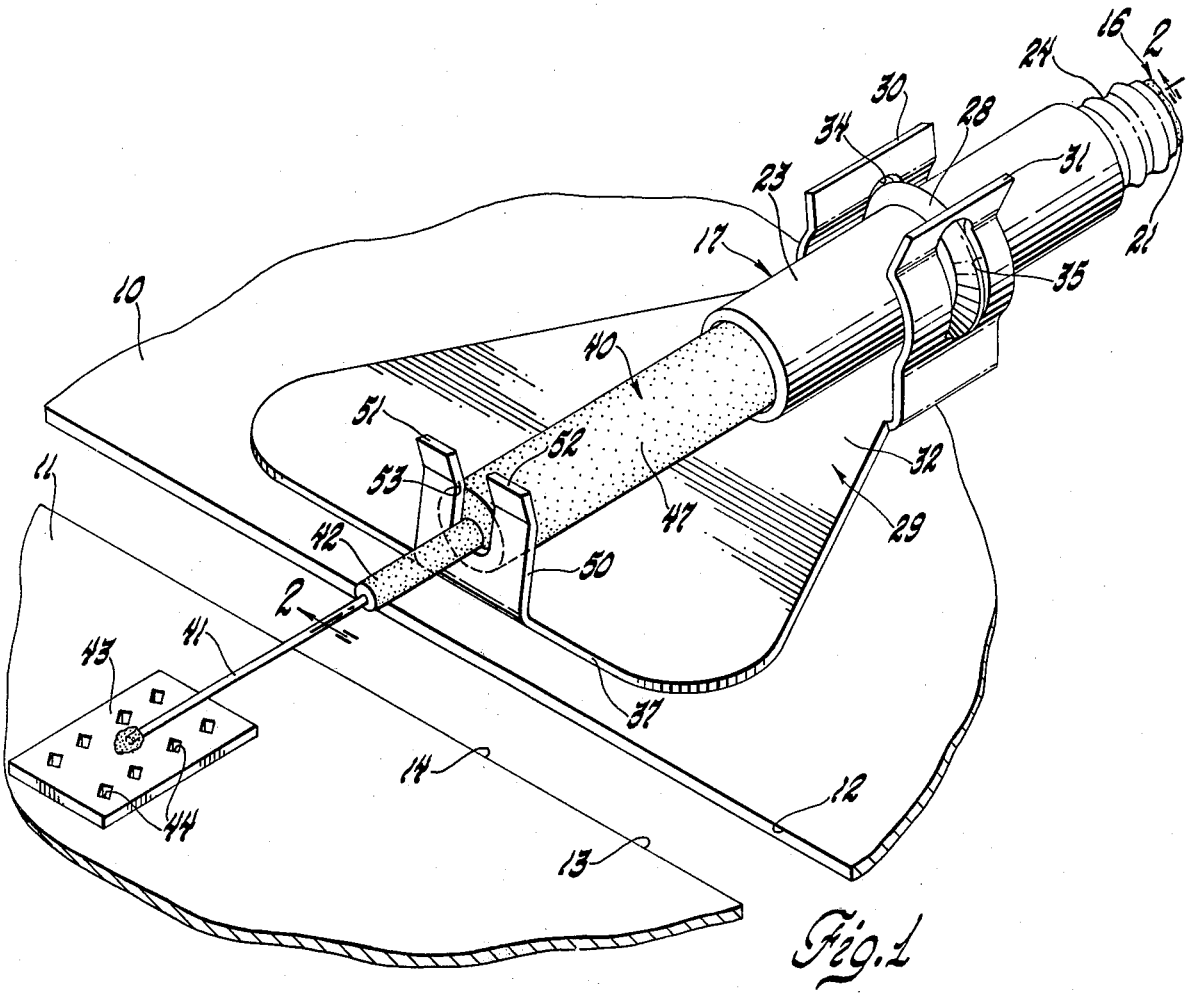
FIG. 1 is a perspective view of a preferred embodiment of this invention.

Referring to FIG. 1, a slot antenna comprises a first antenna member 10 and a second antenna member 11. Slot antenna members 10 and 11 comprise generally flat, co-planar, electrically conducting members, only a portion of each being shown in FIG. 1. Antenna members 10 and 11 are provided with edges 12 and 13, respectively, which define a slot 14 therebetween, the slot 14 thereby providing antenna characteristics for said members 10 and 11 in a manner well known in the art of antennas.

Figure 2:
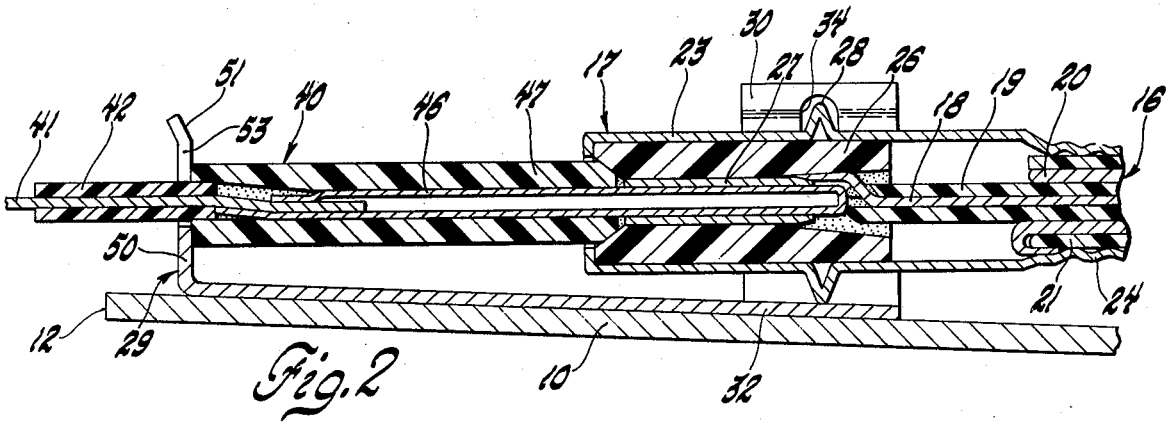
FIG. 2 is a section view along lines 2—2 in FIG. 1.

A coaxial antenna lead 16 has a female connector end 17 for connection to the slot antenna, since the male connecting end is connected to electrical apparatus which is not shown in the Figure. The typical construction of the female connector end 17 of coaxial antenna lead 16 is shown in FIGS. 1 and 2. Referring to FIG. 2, it can be seen that coaxial antenna lead 16 generally comprises an inner conductor 18 surrounded by an annular insulator 19. The annular insulator 19 is itself surrounded by a braided outer conductor 20, which is in turn surrounded by an outer annular insulator 21. At the end of the coaxial lead shown, the outer conductor 20 and insulator 21 are cut off shorter than the inner conductor 18 and insulator 19; and an outer annular grounding end member 23 is crimped at one end to the outer insulator 21. As shown in FIG. 2, a portion of the braided outer conductor 20 is bent back around the end of the outer insulator 21 and caught between the crimped end 24 of the grounding end member 23 and the outer insulator 21 for electrical connection with grounding end member 23. Within grounding end member 23 is an annular insulator 26 which supports, in its central opening, an annular conductor 27. The free end of inner conductor 18 is connected to annular conductor 27. Finally, grounding end member 23 is provided with a circumferential projecting ring 28, which aids in physical connection.

Referring again to FIG. 1, a first connecting member of this invention comprises a pair of arms 30 and 31 made of an electrically conducting material such as steel. Arms 30 and 31 face each other in a roughly parallel manner, although each of the arms 30 and 31 has a curvature adapted to fit the grounding end member 23. The arms 30 and 31 are joined in a flat base 32 and spaced so that they clamp in a spring-like manner over grounding end member 23. Arms 30 and 31 are provided with slots 34 and 35, respectively, adapted to receive the projecting ring 28 of grounding end member 23 therein. Thus, arms 30 and 31 clamp and lock onto grounding end member 23, providing electrical conducting continuity between first connecting member 29 and outer conductor 20 of coaxial lead 16.

Base 32 of first connecting member 29 is fixed by soldering or other means to antenna member 10 to anchor the female connector end 17 of coaxial lead 16 physically and connect the outer conductor 20 of coaxial lead 16 electrically to antenna member 10. First connecting member 29 is oriented so that the female end 17 of coaxial antenna lead 16 is directed toward slot 14. Base 32 of first connecting member 29, which is approximately the width of the arms 30 and 31 at the end farthest from the slot, where it joins those arms, flares outwardly in the direction of the slot to a wider end 37 nearest slot 14. Base 32 therefore redirects and spreads the electromagnetic field of coaxial antenna lead 16 over antenna member 10 and thereby dissipates that field before it reaches slot 14.

In order to connect the inner conductor 18 of coaxial lead 16 to antenna member 11, a second connecting member 40 is provided. Member 40 comprises an inner conductor 41 surrounded by an annular insulator 42. One end of second connecting member 40 extends across slot 14, where inner conductor 41 is physically anchored and electrically connected to member 11 by solder or other means. In FIG. 1 the connection is shown as a solder connection to a strip of electrically conducting tape 43 fastened to member 11 by an adhesive. Coatings of electrically conducting paint under and over strip 43, combined with an increased edge length of strip 43 due to a plurality of cut out openings 44 therein, provide good electrical contact between conductor 41 and antenna member 11. This connection is described in more detail in U.S. patent application Ser. No. 49,440, filed by Joseph H. Graeser, Jr. and Robert J. Adkins on the same day as this application and assigned to the same assignee.

The other end of second connecting member 40 is provided with a metallic probe 46 to which inner conductor 41 is connected by crimp and solder, probe 46 being adapted for electrically conducting reception within annular conductor 27 of female connector end 17. An annular sealing member 47 surrounds the portion of conducting probe 46 outside female connector end 17 and extends past the crimp and solder joint between conducting probe 46 and inner conductor 41 to overlap one end of annular insulator 42. In addition to providing an environmental seal for the aforementioned crimp and solder connection and for the open end of female connector end 17, annular sealing member 47, together with a fork extension 50 of first connecting member 29, prevents the accidental withdrawal of second connecting member 40 from female connector end 17.

Fork extension 50 rises substantially perpendicularly from the wide end of flat base 32 and comprises a pair of tines 51 and 52 defining a slot 53 therebetween, through which slot inner conductor 41 and annular insulator 42 extend prior to crossing slot 14. However, the diameter of annular sealing member 47 is larger than the width of slot 53, which causes it to be effectively retained axially between forked extension 50 and female connector end 17. There is sufficient friction between annular sealing member 47 and the members it surrounds such as conducting probe 46 and annular insulator 42 that the entire second connecting member 40 is thus axially fixed and interlocked with the first. Of course, if it is desired to remove the connection, the arms 30 and 31 may be spread to allow removal of coaxial antenna lead 16 from first connecting member 29. This will free the second connecting member from the aforementioned restraint; but as long as coaxial lead 16 is restrained by first connecting member 29, the aforementioned restraint is in effect.

It can thus be seen that the apparatus comprises two connecting members, one of which includes a pair of arms to engage the female connector end of a standard antenna coaxial lead and connect the outer conductor thereof to one antenna member through a base which is designed to dissipate the radial coaxial electromagnet field. A second connecting member is adapted to connect the inner conductor of coaxial antenna lead 16 to the other antenna member 11 and further be retained for said purpose by a forked extension 50 of the first connecting member. The particular embodiment shown is preferred; but equivalent embodiments will occur to those skilled in the art. Therefore this invention should be limited to only by the claims which follow.

The embodiments of the invention in which an exclusive property or privilege is claimed are defined as follows:

1. A pair of physically interlocking connecting members adapted to electrically connect the inner and outer conductors of a coaxial antenna lead through connection to the female connector end thereof to the two members of a slot antenna while preventing interference by the radial electromagnetic field of the coaxial antenna lead with the electromagnetic field of the slot, the pair comprising, in combination:

a first electrically conducting connecting member comprising a flat base adapted for physical and electrical connection to one of said antenna members, a pair of arms projecting outwardly from the end of the base farthest from the slot and being adapted to physically engage the female connector end of the coaxial antenna lead and electrically connect with the outer conductor thereof, and a forked extension projecting outwardly from the end of the base nearest the slot, the base flaring outwardly in width from the end farthest to the end nearest the slot to dissipate the radial electromagnetic field of the coaxial antenna lead; and a second connecting member comprising a conductor adapted at one end to physically engage the female connector end of the coaxial antenna lead and electrically connect with the inner conductor thereof and at the other end to electrically connect with the second antenna member, and further comprising insulating means adapted to engage the forked extension of the first connecting member to interlock therewith.

2. Apparatus for connecting the female connector end of a coaxial antenna lead to a slot antenna comprising two antenna members defining a slot therebetween, the coaxial antenna lead including inner and outer conductors and an outer annular end member electrically connected to the outer conductor and having a radial projection therefrom, said apparatus comprising, in combination:

a first connecting member comprising an electrically conductive material, said connecting member further comprising a pair of arms adapted to engage the outer annular end member therebetween, at least one of said arms having an opening adapted to engage the radial projection, the connecting member further comprising a flat base supporting said arms and adapted to be physically and electrically connected to the first antenna member, whereby the outer conductor is electrically connected to said first antenna member, the base extending from said arms to a slot end adjacent said slot and flaring outwardly from a narrow width by said arms to a wider width at said slot end, whereby the radial electromagnetic field of the coaxial antenna lead is dissipated and does not interfere with the slot electromagnetic field, the first connecting member further comprising a forked extension extending substantially perpendicularly from the slot end of said base; and a second connecting member comprising a conducting member adapted to cross said slot and engage at one end the inner conductor of the coaxial antenna lead and at the other end the second antenna member, the second connecting member further comprising insulating means adapted to engage the forked extension of the first connecting member and thereby prevent accidental withdrawal of the conducting means from engagement with the inner conductor of the coaxial antenna lead.

* * * * *